US009440267B2

(12) United States Patent
Jung

(10) Patent No.: US 9,440,267 B2
(45) Date of Patent: Sep. 13, 2016

(54) TOOL FOR CLEANING VESSELS

(71) Applicant: Hyeon Ho Jung, Seoul (KR)

(72) Inventor: Hyeon Ho Jung, Seoul (KR)

( * ) Notice: Subject to any disclaimer, the term of this patent is extended or adjusted under 35 U.S.C. 154(b) by 0 days.

(21) Appl. No.: 14/700,279

(22) Filed: Apr. 30, 2015

(65) Prior Publication Data

US 2015/0313441 A1 Nov. 5, 2015

(30) Foreign Application Priority Data

Apr. 30, 2014 (KR) ..... 10-2014-0052520

(51) Int. Cl.

| | |
|---|---|
| ***B08B 9/20*** | (2006.01) |
| ***A47L 15/37*** | (2006.01) |
| ***B08B 9/08*** | (2006.01) |
| ***A47L 15/00*** | (2006.01) |
| ***A46B 13/00*** | (2006.01) |

(52) U.S. Cl.

CPC ..... *B08B 9/0826* (2013.01); *A46B 13/001* (2013.01); *A47L 15/0068* (2013.01); *A47L 15/37* (2013.01); *B08B 9/20* (2013.01)

(58) Field of Classification Search

CPC ... A47L 15/37; A47L 15/39; A47L 15/0068; B08B 9/20; B08B 9/28; B08B 9/36; B08B 9/34; B08B 9/087; B08B 9/093; A46B 13/04

USPC ..... 15/56, 59, 65, 71, 75, 101, 24

See application file for complete search history.

(56) References Cited

U.S. PATENT DOCUMENTS

| | | | | | |
|---|---|---|---|---|---|
| 1,662,205 | A * | 3/1928 | Parry | A47L 15/0068 | 15/75 |
| 3,195,157 | A * | 7/1965 | Thorne-Symmons | A47L 15/39 | 15/29 |
| 3,866,265 | A * | 2/1975 | Beazley | A47L 15/0068 | 15/75 |
| 4,115,891 | A * | 9/1978 | Wills | B44D 3/006 | 134/152 |
| 5,507,060 | A * | 4/1996 | Quimpo | A47L 15/0068 | 134/138 |

FOREIGN PATENT DOCUMENTS

| | | | | |
|---|---|---|---|---|
| FR | 1218501 A * | 5/1960 | ..... | A47L 15/39 |
| KR | 200229976 | 4/2001 | | |
| RO | 109152 B1 * | 12/1994 | ..... | A47L 15/37 |

* cited by examiner

*Primary Examiner* — Laura C Guidotti
(74) *Attorney, Agent, or Firm* — Cantor Colburn LLP

(57) ABSTRACT

A vessel washer comprises: a washing tub; a cover element; and a pedal, wherein the washing tub comprises a rotating member, an outer brush, and an inner brush; the rotating member comprises a center branch and a side branch; the center branch and the side branch are rotated and revolved, respectively; the outer brush is disposed at the side branch, and the inner brush is disposed at the center branch; the cover element comprises a pressure part made of resin for pressing a vessel disposed on the center branch in an upside-down manner; and the pedal is pressed or treaded on by a hand or foot of a user to rotate and revolve the center branch and the side branch.

1 Claim, 4 Drawing Sheets

TOOL FOR CLEANING VESSELS

FIELD OF THE INVENTION

The present invention relates to a tool for cleaning vessels or a vessel washer.

BACKGROUND

Various types of vessels are being used in places like houses or restaurants. Among those vessels, rather long cups or bottles have somewhat deep interior in contrast to common vessels, and the inside and outside thereof may be easily contaminated together.

According to a prior art, a user is bound to scrub the inside and outside of a vessel several times using a brush coated with detergent, and then rinse it out with water spouted from a faucet. At this time, the user exposes the hands to detergent and water for at least a few minutes, and thus may be easily affected with a disease such as eczema. Further, this procedure is highly time and energy consuming in itself.

According to another prior art, a user may use an electronically-operated dishwasher to wash vessels. However, such a dishwasher exhibits very low washing efficiency for vessels having rather deep interior, while it is quite sophisticated equipment. One example of the vessels may be baby bottles, and it is actually very difficult to wash such bottles using a dishwasher.

A technique according to Korean Utility Model Registration No. 20-0229976 (the contents of which are incorporated herein by reference in its entirety) can be mentioned as yet another prior art. Although the utility model registration discloses a technique for washing vessels in an electrically-powered manner, the technique has focused only on washing the interior of the vessels and has been actually inadequate for washing the exterior thereof. Further, the technique employs a motor, which makes it difficult to provide a low-priced washer.

Herein, the inventor(s) now present a novel vessel washer, which is most appropriate for use in washing vessels having rather deep interior.

SUMMARY OF THE INVENTION

One object of the present invention is to solve all the above problems in prior art.

Another object of the invention is to provide a vessel washer in which washing is carried out in an economical manner even without electronically-operated sophisticated equipment.

Yet another object of the invention is to provide a time-efficient vessel washer in which the inside and outside of vessels may be washed at the same time.

Still another object of the invention is to provide a vessel washer in which energy required for washing may be supplied in a sufficiently efficient manner just by manual operation of a user.

According to one aspect of the invention to achieve the objects as described above, there is provided a vessel washer comprising: a washing tub; a cover element; and a pedal, wherein the washing tub comprises a rotating member, an outer brush, and an inner brush; the rotating member comprises a center branch and a side branch; the center branch and the side branch are rotated and revolved, respectively; the outer brush is disposed at the side branch, and the inner brush is disposed at the center branch; the cover element comprises a pressure part made of resin for pressing a vessel disposed on the center branch in an upside-down manner; and the pedal is pressed or treaded on by a hand or foot of a user to rotate and revolve the center branch and the side branch.

In addition, there may be further provided other configurations according to the technical idea of the invention.

According to the invention, there is provided a vessel washer in which washing is carried out in an economical manner even without electronically-operated sophisticated equipment.

According to the invention, there is provided a time-efficient vessel washer in which the inside and outside of vessels may be washed at the same time.

According to the invention, there is provided a vessel washer in which energy required for washing may be supplied in a sufficiently efficient manner just by manual operation of a user.

DETAILED DESCRIPTION OF THE PREFERRED EMBODIMENTS

Figure 1:
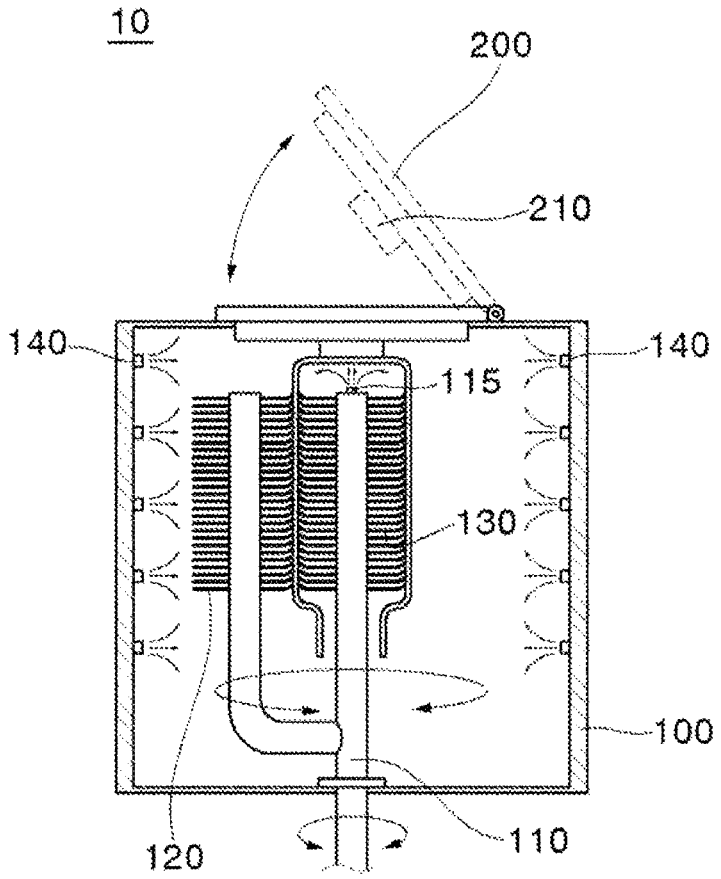
FIG. 1 shows the basic appearance of a vessel washer according to one embodiment of the invention.

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures and characteristics described herein may be implemented as modified from one embodiment to another without departing from the spirit and scope of the invention. Furthermore, it shall be understood that the locations or arrangements of individual elements within each of the embodiments may also be modified without departing from the spirit and scope of the invention. Therefore, the following detailed description is not to be taken in a limiting sense, and the scope of the invention is to be taken as encompassing the scope of the appended claims and all equivalents thereof. In the drawings, like reference numerals refer to the same or similar elements throughout the several views.

Hereinafter, various preferred embodiments of the present invention will be described in detail with reference to the accompanying drawings to enable those skilled in the art to easily implement the invention.

Meanwhile, it should be understood that the term "connection" herein encompasses a direct connection or an indirect connection (i.e., via separate elements) between mechanical or other types of elements.

FIG. 1 shows the basic appearance of a vessel washer according to one embodiment of the invention.

Reference will be made to FIG. 1. A vessel washer 10 may comprise a washing tub 100 and a cover element 200 which may cover an upper opening of the washing tub 100 and may press and fix a vessel.

The washing tub 100 may comprise a rotating member 110, an outer brush 120, and an inner brush 130.

Figure 4:
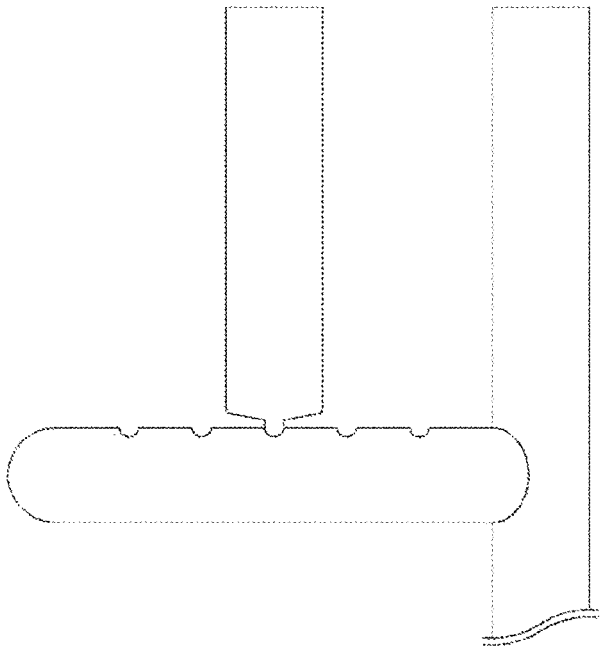
FIG. 4 shows the appearance of a side branch according to one embodiment of the invention.

First, as shown in the drawing, the rotating member 110 may comprise a center branch extending upright and at least one side branch extending from the center branch to one side. When the vessel is washed, it may be disposed on the center branch in an upside-down manner such that the bottom thereof is upraised, as shown. These two types of branches may carry out rotary motion according to a pressing or treading operation of a user to be described below. At this time, the center branch may be rotated while the side branch may be revolved about the center branch and the central axis thereof as an axis of rotation. The center branch and the side branch may be integrally formed. However, the center branch and the side branch may also be configured such that they may be separated from each other while the side branch may be inserted in a side hole of the center branch in a manner in which the depth of insertion may be adjusted. The latter configuration may allow different sizes of vessels to be washed just by simple manual operation of the user. Meanwhile, as shown in FIG. 4, the side branch may comprise a horizontal bar which includes a plurality of interval adjustment holes, and a vertical bar which may be inserted in one of the plurality of holes. In this case, the interval between the side branch and the center branch may be adjusted by changing the hole in which the vertical bar is inserted. This configuration may also allow different sizes of vessels to be washed just by simple manual operation of the user.

Further, the outer brush 120 may be disposed at the upper part or another part of the side branch as described above. The outer brush 120 may be of the same shape (e.g., with bristles being circumferentially disposed, with bristles being disposed on only one side, etc.) and material (e.g., plastic, cloth, etc.) as a conventional wash brush. However, the outer brush 120 is preferably configured not to have excessively high density so that water to be described below may flow downward well.

Furthermore, the inner brush 130 may be disposed at the upper part or another part of the center branch as described above. The inner brush 130 may also be of the same shape and material as a conventional wash brush. The inner brush 130 is also preferably configured not to have excessively high density so that water to be described below may flow downward well.

Although it has been illustrated in the drawing that the outer brush 120 and the inner brush 130 are integrally coupled to the rotating member 110, at least one of the outer brush 120 and the inner brush 130 may be removably attached to the side branch or the center branch of the rotating member 110.

Meanwhile, water may be spouted from an upper tip of the center branch of the rotating member 110 through a center nozzle 115. Water, water containing detergent, water for rinsing, or the like may be spouted from the nozzle 115. (Preferably, clean water may be spouted from the nozzle 115 because a vessel is washed after detergent has been applied thereto in some degree.) The nozzle 115 may be connected to a water source (not shown) through an inner space of the center branch of the rotating member 110. The water source may be, for example, a hose (not shown) connected to a nearby faucet (not shown).

Meanwhile, the inner side surface of the washing tub 100 may include a plurality of side nozzles 140. The nozzles 140 may spout water, water containing detergent, water for rinsing, or the like onto the outer surface of a vessel. It is apparent that the nozzles 140 may also be connected to the water source.

In addition, the cover element 200 may be further provided. The cover element 200 may be coupled to the upper opening of the washing tub 100 by means of a hinge. Here, the upper opening of the washing tub 100 preferably has a sufficient width suitable to ensure that a vessel may be disposed within or retrieved from the washing tub 100 by a user. The cover element 200 may preferably be configured to completely shut up the upper opening of the washing tub 100 when being put on.

The cover element 200 may further comprise a pressure part 210 as shown. The pressure part 210 may function to adequately press the overturned and upraised bottom part of the vessel, which is disposed to face the cover element 200 when it is put on, such that the vessel is not rotated along even when the outer brush 120 and the inner brush 130 provide frictional force according to rotation of the rotating member 110. To this end, the pressure part 210 may be formed from a material such as natural resin or synthetic resin, which exhibits a high friction coefficient when contacting the vessel (usually consisting of thermosetting plastic, glass, wood, or the like). Meanwhile, the pressure part 210 may have any shape required to substantially fix the vessel, without being necessarily limited to the shape shown in the drawing. For example, the pressure part 210 may be configured in a shape to surround and grab the part adjacent to the bottom of the vessel, or to include a groove in which the vessel may be fitted. Further, the pressure part 210 may be integrally formed with the cover element 200, but may also be attached thereto.

Figure 2:
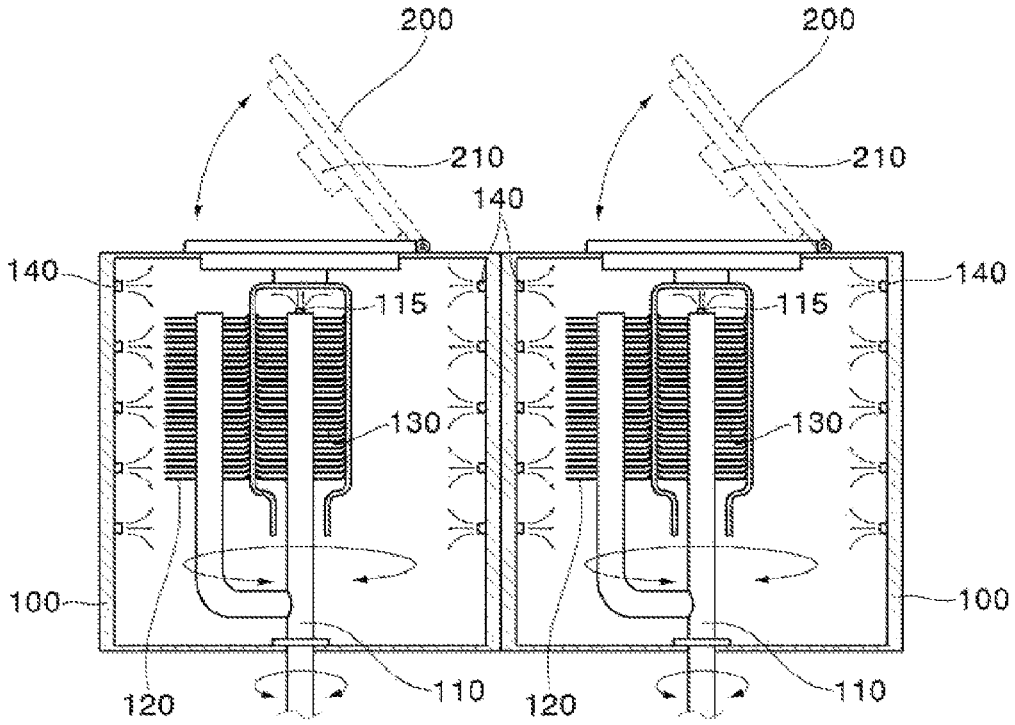
FIG. 2 shows the appearance of a vessel washer according to another embodiment of the invention.

FIG. 2 shows the appearance of a vessel washer according to another embodiment of the invention. As shown in FIG. 2, the vessel washer 100 may not only be a single washer, but may also constitute a single cell of entire equipment in which a number of the vessel washers 100 are coupled. The equipment may comprise a plurality of cells of the washers 100 for use in washing a number of (i.e., two or more) vessels at the same time. Here, the rotating members 110 of the washers 100 of the respective cells may be rotated by being driven all together by means of a power unit to be described below (i.e., pedal) or other types of power unit (e.g., a power unit driven by an electric motor.)

Figure 3:
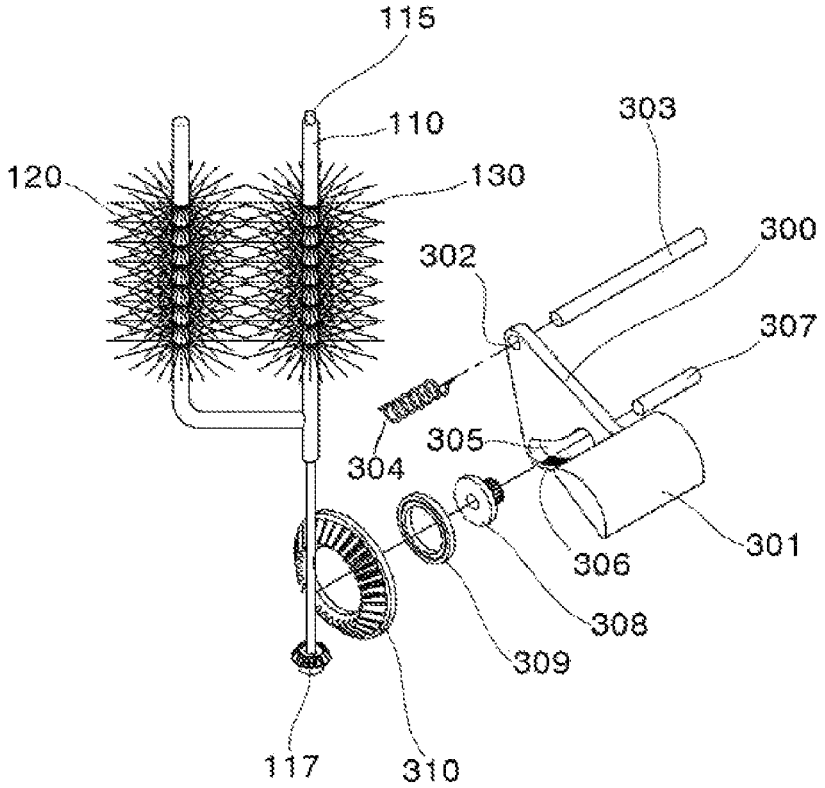
FIG. 3 shows the appearance of a pedal for a vessel washer according to one embodiment of the invention.

FIG. 3 shows the appearance of a pedal for a vessel washer according to one embodiment of the invention. As shown in FIG. 3, the vessel washer 10 may further comprise a pedal 300 for the washer, which may be used as a kind of power unit. That is, the pedal 300 may be pressed or treaded on by a hand or foot of a user to rotate the rotating member 110 and wash a vessel as described above.

The pedal 300 may comprise a pressing plate 301, a main shaft groove 302, a main shaft 303, a restoration spring 304, a rotation groove 305, an internal gear 306, a rotation shaft 307, a circular gear 308, a one-way clutch 309, and a ring gear 310. Meanwhile, the rotating member 110 may comprise a bevel gear 117 at the bottom thereof as shown, so that it may receive torque from the pedal 300.

It will be discussed in detail. First, a user may press or tread on the pressing plate 301 of the pedal 300. When the pressing plate 301 is accordingly pressed, the pedal 300 is rotated about the main shaft 303 fitted in the main shaft groove 302 as a central axis, generally in a downward direction. At this time, the rotation groove 305 and the internal gear 306 formed therein may also be rotated together in the downward direction. The circular gear 308 may contact the internal gear 306, and may be rotated about the rotation shaft 307 as a central axis. Therefore, the circular gear 308 may also be rotated counterclockwise as viewed in the drawing, according to the rotation of the rotation groove 305 and the internal gear 306. The one-way clutch 309 may be disposed to contact the outer circumferential surface of the circular gear 308. The one-way clutch 309 may be a commonly known element to allow the rotation of the circular gear 308 to be transmitted to the ring gear 310 to be described below only in one direction (e.g., only in the counterclockwise direction). The one-way clutch 309 may contact the inner circumferential surface of the ring gear 310. The ring gear 310 may receive the rotation from the circular gear 308 via the one-way clutch 309, and transmit it to the bevel gear 117 as shown, with only the plane of the axis of rotation being changed. Thus, the user may easily generate power for washing the vessel by pressing or treading on the pedal 300, and may transmit the rotation caused thereby to the rotating member 110 in one direction. Meanwhile, the restoration spring 304 may be disposed at the main shaft 303. Accordingly, the pressing plate 301, the internal gear 306, the rotation shaft 307, and the like may be restored to their original positions soon after the user presses or treads on the pedal 300 once. Therefore, the user may successively press or tread on the pedal 300 so that the rotation sufficient to complete washing the vessel may be transmitted to the rotating member 110.

Although the present invention has been described in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A vessel washer comprising:

a washing tub;

a cover element; and a pedal, wherein the washing tub comprises a rotating member, an outer brush, and an inner brush;

the rotating member comprises a center branch and a side branch;

the center branch and the side branch are rotated and revolved, respectively;

the outer brush is disposed at the side branch, and the inner brush is disposed at the center branch;

the cover element comprises a pressure part made of resin for pressing a vessel disposed on the center branch in an upside-down manner;

the pedal is pressed or treaded on by a hand or foot of a user to rotate and revolve the center branch and the side branch;

a center nozzle is disposed at the center branch, and water for washing the inside of the vessel is spouted from the center nozzle;

a side nozzle is disposed at the inner side surface of the washing tub, and water for washing the outside of the vessel is spouted from the side nozzle;

the pedal comprises a rotation groove, an internal gear formed at the rotation groove, a circular gear contacting the internal gear, a one-way clutch disposed at the outer circumferential surface of the circular gear, and a ring gear wherein the one-way clutch is disposed at the inner circumferential surface thereof;

the ring gear is configured to rotate a bevel gear of the rotating member;

the pedal is rotated downward about a main shaft as an axis of rotation when a pressing plate thereof is pressed, and then restored by a restoration spring;

the side branch comprises a horizontal bar including a plurality of interval adjustment holes, and a vertical bar capable of being inserted in one of the plurality of interval adjustment holes;

the interval between the center branch and the side branch is adjusted by changing the interval adjustment hole in which the vertical bar is inserted among the plurality of interval adjustment holes;

the pressure part is configured in a shape to surround and grab the part adjacent to the bottom of the vessel, or to include a groove in which the vessel is capable of being fitted;

the ring gear receives rotation from the circular gear via the one-way clutch, and transmits the rotation to the bevel gear with the plane of the axis of rotation being changed; and the pedal is capable of being successively pressed or treaded on by the hand or foot of the user.

* * * * *